US010677197B2

(12) United States Patent
Dudar

(10) Patent No.: US 10,677,197 B2
(45) Date of Patent: Jun. 9, 2020

(54) EVAPORATIVE EMISSIONS DIAGNOSTIC DURING A REMOTE START CONDITION

(71) Applicant: Ford Global Technologies, LLC, Dearborn, MI (US)

(72) Inventor: Aed M. Dudar, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 440 days.

(21) Appl. No.: 15/046,984

(22) Filed: Feb. 18, 2016

(65) Prior Publication Data

US 2017/0241376 A1 Aug. 24, 2017

(51) Int. Cl.
*F02M 25/08* (2006.01)

(52) U.S. Cl.
CPC ..... *F02M 25/0809* (2013.01)

(58) Field of Classification Search
CPC ..... F02M 25/0809
See application file for complete search history.

(56) References Cited

U.S. PATENT DOCUMENTS 5,396,873 A * 3/1995 Yamanaka ..... F02M 25/0809 123/520
6,016,690 A 1/2000 Cook et al.
6,308,119 B1 * 10/2001 Majkowski ..... F02M 25/0809 123/520
6,429,773 B1 8/2002 Schuyler
6,595,570 B2 7/2003 Susko
6,666,072 B2 12/2003 Hirano et al.
6,879,894 B1 4/2005 Lightner et al.
7,650,864 B2 1/2010 Hassan et al.
8,375,913 B2 2/2013 Kwiecinski et al.
8,410,918 B1 4/2013 Stroud
8,849,503 B1 9/2014 Dudar
(Continued)

OTHER PUBLICATIONS

VitroPlus/Ziebart. (Dec. 19, 2014). Remote starter history. Retrieved from https://www.vitroplus.com/en/blog/1-9-remote-starter-history.html.*

(Continued)

*Primary Examiner* — Alexander A Mercado
(74) *Attorney, Agent, or Firm* — Geoffrey Brumbaugh; McCoy Russell LLP

(57) ABSTRACT

Methods and systems are provided for conducting an evaporative emissions test responsive to an indication of a vehicle remote engine start event. In one example, responsive to an indication of a remote start and further indication that the vehicle is not occupied, intake manifold vacuum is utilized to reduce pressure in the fuel system and evaporative emissions system to a threshold, wherein the fuel system and evaporative emissions system are sealed, and undesired evaporative emissions indicated responsive to a pressure bleed-up rate greater than a threshold. In this way, by applying intake manifold vacuum on the fuel system and evaporative emissions system while the vehicle is stationary and not occupied, engine hesitations resulting from desorption of fuel vapors from a fuel vapor canister are not experienced by the vehicle operator and/or passengers, and noise factors from driving conditions, passenger movement, etc., do not impact the evaporative emissions test.

17 Claims, 4 Drawing Sheets

(56) References Cited

U.S. PATENT DOCUMENTS

| | | | | |
|---|---|---|---|---|
| 2001/0004844 | A1* | 6/2001 | Yamaki | F02M 25/0809 73/40.5 R |
| 2011/0148566 | A1* | 6/2011 | Ledendecker | B60R 25/04 340/3.1 |
| 2013/0032127 | A1* | 2/2013 | Jentz | F02N 11/003 123/520 |
| 2013/0297177 | A1* | 11/2013 | Kim | F02M 25/0809 701/102 |
| 2014/0260549 | A1 | 9/2014 | Dudar et al. | |
| 2015/0019066 | A1* | 1/2015 | Dudar | F02M 25/0809 701/29.7 |
| 2015/0073652 | A1* | 3/2015 | Bennie | B60W 50/00 701/36 |
| 2015/0090006 | A1 | 4/2015 | Peters et al. | |
| 2016/0025588 | A1* | 1/2016 | Dudar | G01K 3/14 73/40.5 R |
| 2017/0328287 | A1* | 11/2017 | Leone | F02D 41/0225 |
| 2017/0328292 | A1* | 11/2017 | Leone | B60W 10/00 |

OTHER PUBLICATIONS

Dudar, Aed M., "Methods and System for an Evaporative Emissions System Leak Test Using an External Pressure Source," U.S. Appl. No. 14/799,742, filed Jul. 15, 2015, 44 pages.

* cited by examiner

EVAPORATIVE EMISSIONS DIAGNOSTIC DURING A REMOTE START CONDITION

FIELD

The present description relates generally to methods and systems for controlling a vehicle engine to reduce undesired evaporative emissions.

BACKGROUND/SUMMARY

Vehicle emission control systems may be configured to store fuel vapors from fuel tank refueling and diurnal engine operations, and then purge the stored vapors during a subsequent engine operation. In an effort to meet stringent federal emissions regulations, emission control systems may be intermittently diagnosed for the presence of undesired emissions that could release fuel vapors to the atmosphere. Undesired evaporative emissions may be identified using engine-off natural vacuum (EONV) during conditions when a vehicle engine is not operating. In particular, a fuel system and/or an emissions control system may be isolated at an engine-off event. The pressure in such a fuel system and/or an emissions control system will increase if the tank is heated further (e.g., from hot exhaust or a hot parking surface) as liquid fuel vaporizes. As a fuel tank cools down, a vacuum is generated therein as fuel vapors condense to liquid fuel. Vacuum generation is monitored and undesired emissions identified based on expected vacuum development or expected rates of vacuum development. However, the entry conditions and thresholds for a typical EONV test may be based on an inferred total amount of heat rejected into the fuel tank during the prior drive cycle. The inferred amount of heat may be based on engine run-time, integrated mass air flow, miles driven, etc. If these conditions are not met, the entry into the evaporative emissions test is aborted. Thus, hybrid electric vehicles, including plug-in hybrid electric vehicles (HEV's or PHEV's), particularly pose a problem for effectively controlling evaporative emissions. For example, primary power in a hybrid vehicle may be provided by the electric motor, resulting in an operating profile in which the engine is run only for short periods. As such, adequate heat rejection to the fuel tank may not be available for EONV diagnostics.

An alternative to relying on inferred sufficient heat rejection for entry into an EONV diagnostic test is to instead actively pressurize or evacuate the fuel system and/or emissions control system via an external source. For example, a method may perform a pressure-based evaporative emissions test using a pump to pressurize and/or evacuate the fuel system and/or emissions control system. The fuel system and/or evaporative emissions control system may then be monitored for a selected time period, and if the pressure falls below a threshold value if initially pressurized, or rises above a threshold value if initially evacuated, the system identifies undesired emissions. As such, by conducting evaporative emissions tests via the use of an external pressure source, reliance on heat rejected from the engine may be circumvented.

In one example, the external pressure source may comprise engine intake manifold vacuum during engine operation. In such an example, the fuel system and/or evaporative emissions system may be sealed from atmosphere, and subsequently engine intake manifold vacuum may be applied to the fuel system and evaporative emissions system by commanding open a valve positioned between the fuel system and/or evaporative emissions system, and engine intake. With engine intake manifold vacuum applied to the fuel system and/or evaporative emissions system, pressure in the fuel system and/or evaporative emissions system may decrease to a predetermined negative pressure threshold. Once the predetermined negative pressure threshold is reached, the fuel system and/or evaporative emissions system may be sealed from the engine, and pressure bleed-up monitored. An increase in pressure to a threshold pressure level during a predetermined time duration may indicate undesired evaporative emissions. However, in such an approach, during the pressure bleed-up phase, fuel slosh from road feedback may skew results as a result of increased pressure in the fuel system due to fuel movement. Some examples where fuel slosh may be an issue for an evaporative emissions test relying on pressure bleed-up may include situations where a vehicle operator or passenger enters a car and/or moves around in a seat, when a door is slammed, when a truck is opened and/or closed, when the vehicle is driven in a stop and go fashion, or when the vehicle is driven on windy and/or bumpy roads. If slosh is detected, via a fuel level sensor for example, the evaporative emissions test may be aborted, thus decreasing completion rates for evaporative emissions test diagnostics. Federal emission regulations require completion rates above preselected rates.

U.S. Pat. No. 6,308,119 teaches diagnosing undesired evaporative emissions at engine idle, where the evaporative emissions system is closed and drawn down to a reference negative pressure during a drive cycle via engine intake vacuum. Upon an indication that engine idle is achieved, the evaporative emissions system is sealed from the engine intake vacuum, and the evaporative emissions test conducted by monitoring bleed-up as described above. However, the inventors herein have recognized potential issues with such a method. For example, in such a method, fuel in the fuel system may be hot, and may thus contribute to increased pressure in the fuel system and evaporative emissions system during the evaporative emissions test procedure, potentially resulting in false failures. Additionally, while U.S. Pat. No. 6,308,119 teaches sealing the evaporative emissions system from the engine responsive to an indication that the vehicle is at engine idle, the act of stopping the vehicle may result in waves in the fuel that may translate into fuel vaporization, thus raising pressure in the fuel system and evaporative emissions system and potentially resulting in false evaporative emission leaks.

Thus, the inventors herein have recognized the above issues, and developed systems and methods to at least partially address them. In one example, a method is provided, comprising responsive to a command from a location external to the vehicle to start a combustion engine in the vehicle, reducing pressure in a fuel system which supplies fuel to the engine and an evaporative emissions system coupled to the fuel system to a predetermined pressure, and indicating undesired evaporative emissions responsive to a subsequent pressure increase rate in the fuel system and evaporative emissions system greater than a threshold pressure rate.

In one example, applying negative pressure on the evaporative emissions space to conduct a test for undesired evaporative emissions further includes indicating that doors and a trunk of the vehicle are closed, and that fuel temperature in a fuel tank which supplies fuel to the engine is below a fuel temperature threshold, wherein the fuel temperature threshold comprises fuel temperature where fuel does not readily vaporize. In this way, by conducting a test for undesired evaporative emissions during conditions wherein the vehicle engine has been started remotely, and wherein the vehicle is indicated to be unoccupied, with doors and trunk closed, and without fuel vaporization, conditions that may skew results of such a test may be avoided, and completion rates increased.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 2:
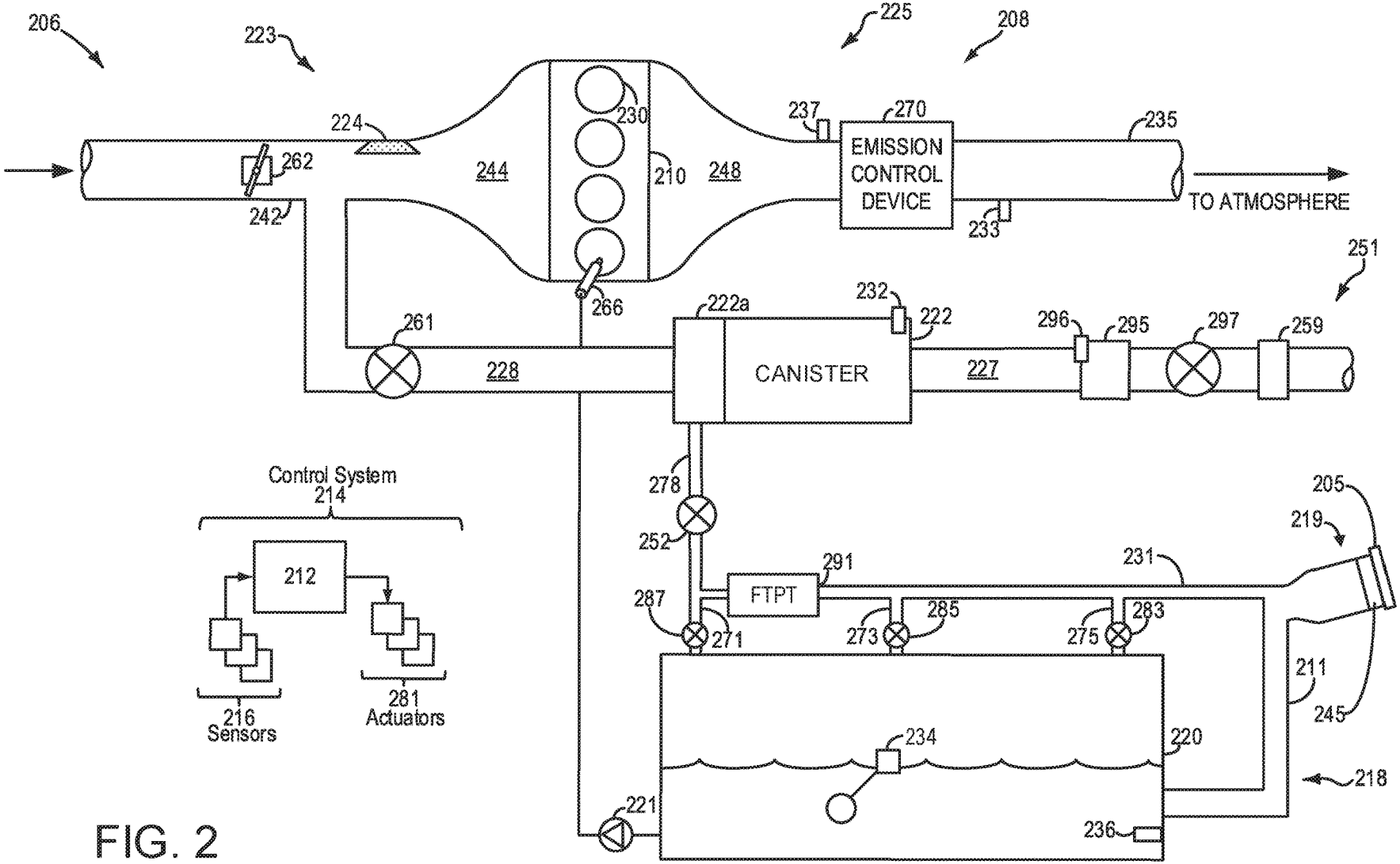
FIG. 2 schematically shows an example vehicle system with a fuel system and an evaporative emissions system.
Figure 3:
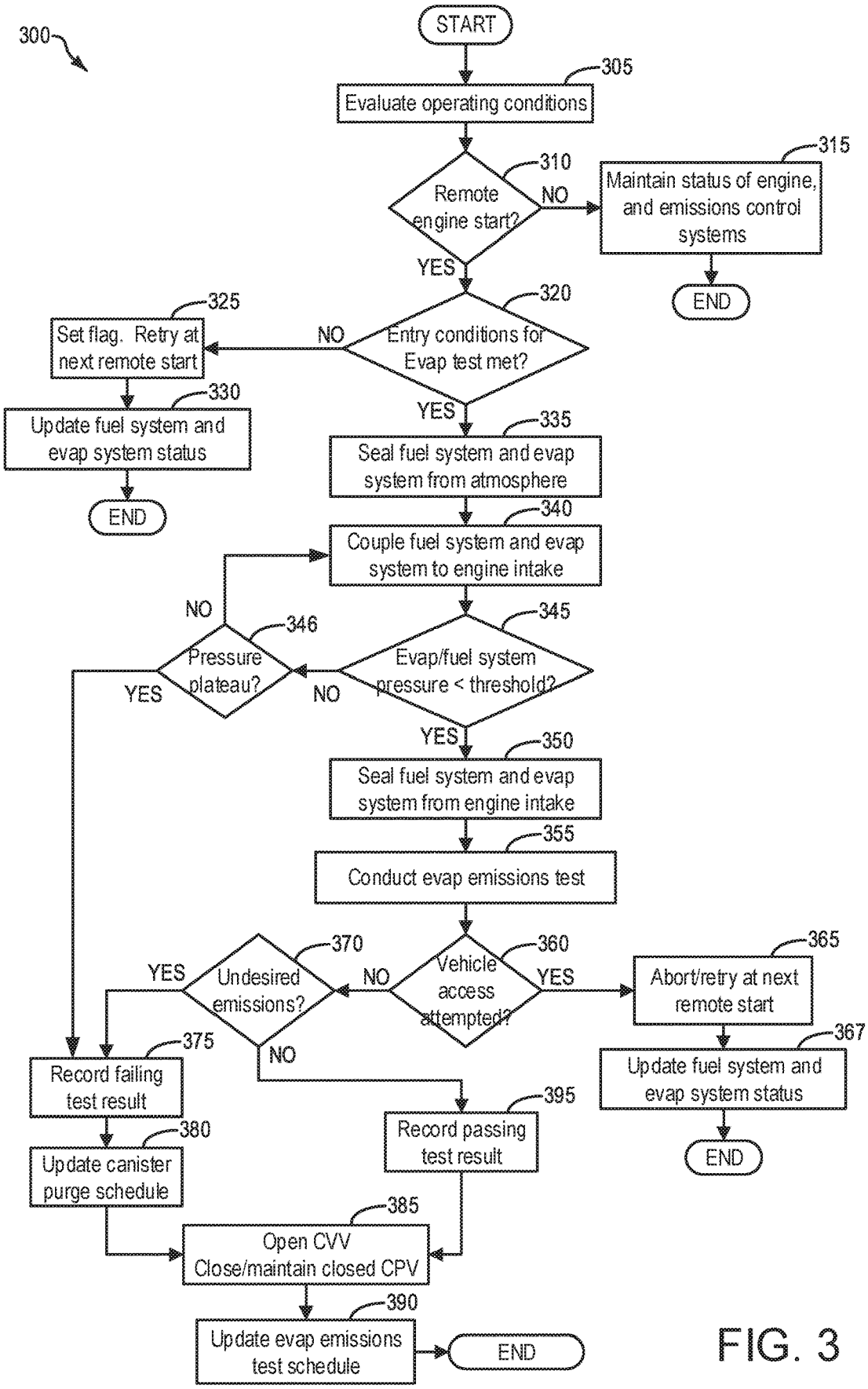
FIG. 3 shows a flowchart for an example method for conducting an evaporative emissions test responsive to a vehicle remote start event.
Figure 4:
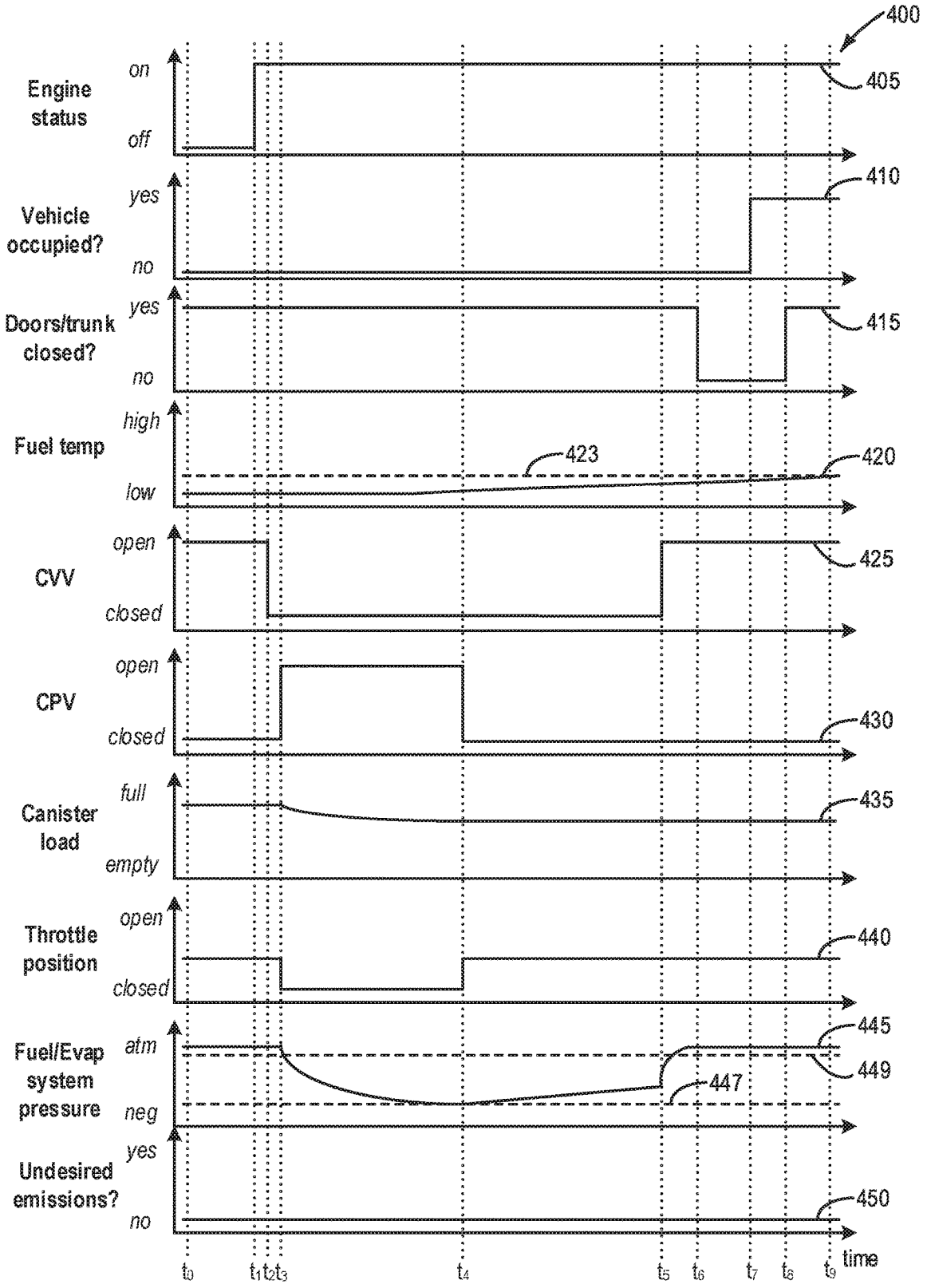
FIG. 4 shows a timeline for conducting an evaporative emissions test responsive to a vehicle remote start event, according to the method depicted in FIG. 3.

This detailed description relates to systems and methods for conducting an evaporative emissions test diagnostic procedure responsive to an indication of a vehicle engine remote start event. Specifically, the description relates to indicating whether a vehicle engine remote start has been initiated, and responsive to an indication that the vehicle is not occupied, that vehicle doors/truck, etc., are not open, and that fuel temperature is stable and below a threshold temperature, initiating the evaporative emissions test. The system and methods may be applied to a vehicle system capable of remote-starting a vehicle engine, such as the vehicle system depicted in FIG. 1. While the vehicle system depicted in FIG. 1 comprises a hybrid vehicle system, the illustration of a hybrid vehicle is not meant to be limiting, and the system and methods depicted herein may be applied to a non-hybrid vehicle without departing from the scope of the present disclosure. Further, in some examples, the vehicle may comprise an autonomous vehicle, where autonomous driving sensors may generate signals that help navigate the vehicle while the vehicle is operating in an autonomous (e.g., driverless) mode. The engine may be coupled to an emissions control system and fuel system, as depicted in FIG. 2. To conduct the evaporative emissions test, the emissions system and fuel system may be sealed from atmosphere, and engine intake manifold vacuum may be applied to the fuel system and evaporative emissions system. Responsive to pressure in the fuel system and evaporative emissions system reaching a negative pressure threshold, the fuel system and evaporative emissions system may be sealed from the engine, and pressure in the fuel system and evaporative emissions system monitored. If, during a predetermined duration, pressure in the fuel system and evaporative emissions system does not rise to a predetermined threshold level, an absence of undesired evaporative emissions may be indicated. A detailed method for conducting the evaporative emissions test procedure responsive to a vehicle remote start event is shown in FIG. 3. A timeline for conducting the evaporative emissions test procedure responsive to an indication of a vehicle remote start event according to the method of FIG. 3, is depicted in FIG. 4.

Figure 1:
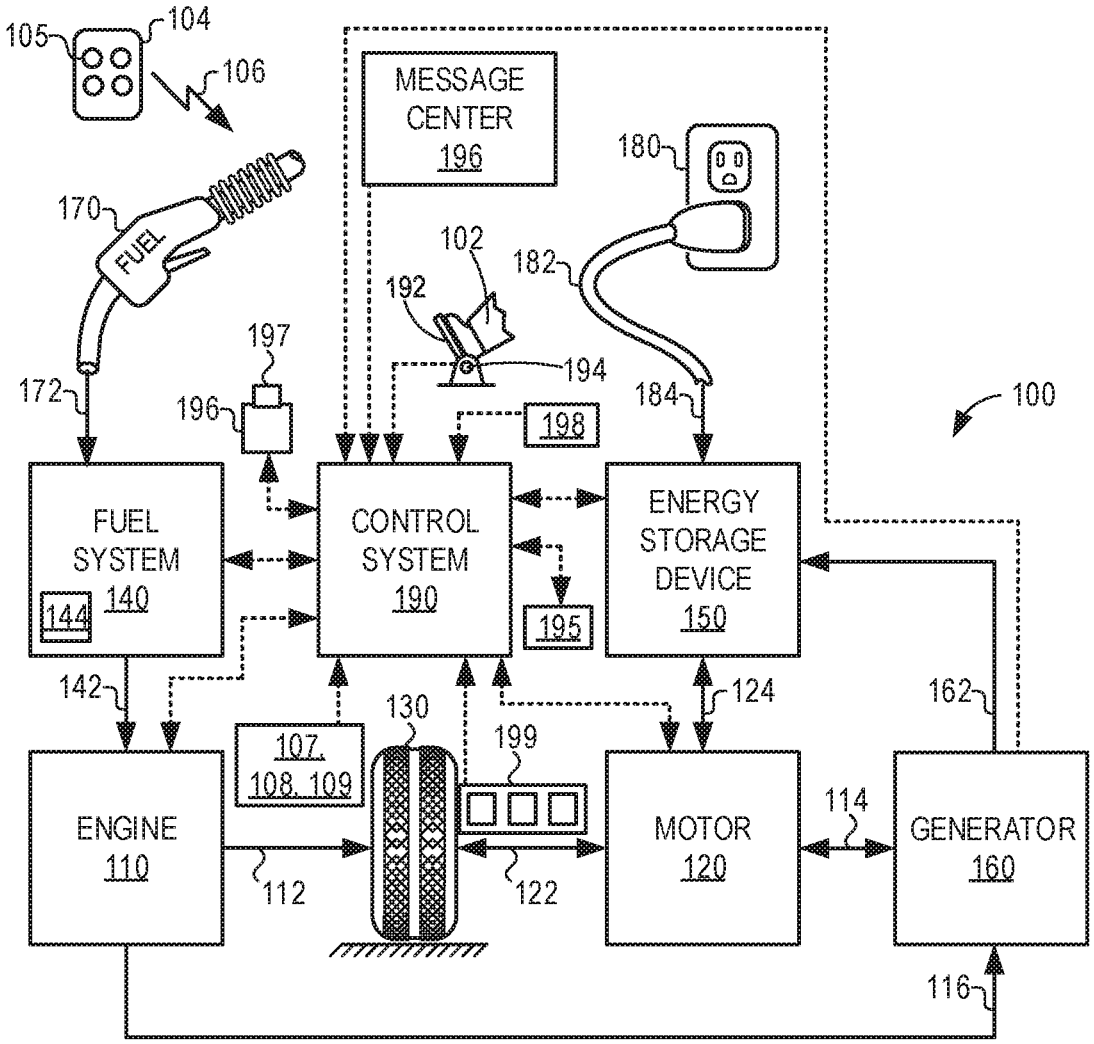
FIG. 1 schematically shows an example vehicle propulsion system.

FIG. 1 illustrates an example vehicle propulsion system 100. Vehicle propulsion system 100 includes a fuel burning engine 110 and a motor 120. As a non-limiting example, engine 110 comprises an internal combustion engine and motor 120 comprises an electric motor. Motor 120 may be configured to utilize or consume a different energy source than engine 110. For example, engine 110 may consume a liquid fuel (e.g., gasoline) to produce an engine output while motor 120 may consume electrical energy to produce a motor output. As such, a vehicle with propulsion system 100 may be referred to as a hybrid electric vehicle (HEV).

Vehicle propulsion system 100 may utilize a variety of different operational modes depending on operating conditions encountered by the vehicle propulsion system. Some of these modes may enable engine 110 to be maintained in an off state (i.e. set to a deactivated state) where combustion of fuel at the engine is discontinued. For example, under select operating conditions, motor 120 may propel the vehicle via drive wheel 130 as indicated by arrow 122 while engine 110 is deactivated.

During other operating conditions, engine 110 may be set to a deactivated state (as described above) while motor 120 may be operated to charge energy storage device 150. For example, motor 120 may receive wheel torque from drive wheel 130 as indicated by arrow 122 where the motor may convert the kinetic energy of the vehicle to electrical energy for storage at energy storage device 150 as indicated by arrow 124. This operation may be referred to as regenerative braking of the vehicle. Thus, motor 120 can provide a generator function in some embodiments. However, in other embodiments, generator 160 may instead receive wheel torque from drive wheel 130, where the generator may convert the kinetic energy of the vehicle to electrical energy for storage at energy storage device 150 as indicated by arrow 162.

During still other operating conditions, engine 110 may be operated by combusting fuel received from fuel system 140 as indicated by arrow 142. For example, engine 110 may be operated to propel the vehicle via drive wheel 130 as indicated by arrow 112 while motor 120 is deactivated. During other operating conditions, both engine 110 and motor 120 may each be operated to propel the vehicle via drive wheel 130 as indicated by arrows 112 and 122, respectively. A configuration where both the engine and the motor may selectively propel the vehicle may be referred to as a parallel type vehicle propulsion system. Note that in some embodiments, motor 120 may propel the vehicle via a first set of drive wheels and engine 110 may propel the vehicle via a second set of drive wheels.

In other embodiments, vehicle propulsion system 100 may be configured as a series type vehicle propulsion system, whereby the engine does not directly propel the drive wheels. Rather, engine 110 may be operated to power motor 120, which may in turn propel the vehicle via drive wheel 130 as indicated by arrow 122. For example, during select operating conditions, engine 110 may drive generator 160, as indicated by arrow 116, which may in turn supply electrical energy to one or more of motor 120 as indicated by arrow 114 or energy storage device 150 as indicated by arrow 162. As another example, engine 110 may be operated to drive motor 120 which may in turn provide a generator function to convert the engine output to electrical energy, where the electrical energy may be stored at energy storage device 150 for later use by the motor.

Fuel system 140 may include one or more fuel storage tanks 144 for storing fuel on-board the vehicle. For example, fuel tank 144 may store one or more liquid fuels, including but not limited to: gasoline, diesel, and alcohol fuels. In some examples, the fuel may be stored on-board the vehicle as a blend of two or more different fuels. For example, fuel tank 144 may be configured to store a blend of gasoline and ethanol (e.g., E10, E85, etc.) or a blend of gasoline and methanol (e.g., M10, M85, etc.), whereby these fuels or fuel blends may be delivered to engine 110 as indicated by arrow 142. Still other suitable fuels or fuel blends may be supplied to engine 110, where they may be combusted at the engine to produce an engine output. The engine output may be utilized to propel the vehicle as indicated by arrow 112 or to recharge energy storage device 150 via motor 120 or generator 160.

In some embodiments, energy storage device 150 may be configured to store electrical energy that may be supplied to other electrical loads residing on-board the vehicle (other than the motor), including cabin heating and air conditioning, engine starting, headlights, cabin audio and video systems, etc. As a non-limiting example, energy storage device 150 may include one or more batteries and/or capacitors.

Control system 190 may communicate with one or more of engine 110, motor 120, fuel system 140, energy storage device 150, and generator 160. For example, control system 190 may receive sensory feedback information from one or more of engine 110, motor 120, fuel system 140, energy storage device 150, and generator 160. Further, control system 190 may send control signals to one or more of engine 110, motor 120, fuel system 140, energy storage device 150, and generator 160 responsive to this sensory feedback. Control system 190 may receive an indication of an operator requested output of the vehicle propulsion system from a vehicle operator 102. For example, control system 190 may receive sensory feedback from pedal position sensor 194 which communicates with pedal 192. Pedal 192 may refer schematically to a brake pedal and/or an accelerator pedal. Furthermore, in some examples control system 190 may be in communication with a remote engine start receiver 195 (or transceiver) that receives wireless signals 106 from a key fob 104 having a remote start button 105. In other examples (not shown), a remote engine start may be initiated via a cellular telephone, or smartphone based system where a user's cellular telephone sends data to a server and the server communicates with the vehicle to start the engine.

Energy storage device 150 may periodically receive electrical energy from a power source 180 residing external to the vehicle (e.g., not part of the vehicle) as indicated by arrow 184. As a non-limiting example, vehicle propulsion system 100 may be configured as a plug-in hybrid electric vehicle (PHEV), whereby electrical energy may be supplied to energy storage device 150 from power source 180 via an electrical energy transmission cable 182. During a recharging operation of energy storage device 150 from power source 180, electrical transmission cable 182 may electrically couple energy storage device 150 and power source 180. While the vehicle propulsion system is operated to propel the vehicle, electrical transmission cable 182 may disconnected between power source 180 and energy storage device 150. Control system 190 may identify and/or control the amount of electrical energy stored at the energy storage device, which may be referred to as the state of charge (SOC).

In other embodiments, electrical transmission cable 182 may be omitted, where electrical energy may be received wirelessly at energy storage device 150 from power source 180. For example, energy storage device 150 may receive electrical energy from power source 180 via one or more of electromagnetic induction, radio waves, and electromagnetic resonance. As such, it should be appreciated that any suitable approach may be used for recharging energy storage device 150 from a power source that does not comprise part of the vehicle. In this way, motor 120 may propel the vehicle by utilizing an energy source other than the fuel utilized by engine 110.

Fuel system 140 may periodically receive fuel from a fuel source residing external to the vehicle. As a non-limiting example, vehicle propulsion system 100 may be refueled by receiving fuel via a fuel dispensing device 170 as indicated by arrow 172. In some embodiments, fuel tank 144 may be configured to store the fuel received from fuel dispensing device 170 until it is supplied to engine 110 for combustion. In some embodiments, control system 190 may receive an indication of the level of fuel stored at fuel tank 144 via a fuel level sensor. The level of fuel stored at fuel tank 144 (e.g., as identified by the fuel level sensor) may be communicated to the vehicle operator, for example, via a fuel gauge or indication in a vehicle instrument panel 196.

The vehicle propulsion system 100 may also include an ambient temperature/humidity sensor 198, and sensors dedicated to indicating the occupancy-state of the vehicle, for example seat load cells 107, door sensing technology 108, and onboard cameras 109. Vehicle propulsion system 100 may also include inertial sensors 199. Inertial sensors may comprise one or more of the following: longitudinal, latitudinal, vertical, yaw, roll, and pitch sensors. The vehicle instrument panel 196 may include indicator light(s) and/or a text-based display in which messages are displayed to an operator. The vehicle instrument panel 196 may also include various input portions for receiving an operator input, such as buttons, touch screens, voice input/recognition, etc. For example, the vehicle instrument panel 196 may include a refueling button 197 which may be manually actuated or pressed by a vehicle operator to initiate refueling. For example, as described in more detail below, in response to the vehicle operator actuating refueling button 197, a fuel tank in the vehicle may be depressurized so that refueling may be performed.

In an alternative embodiment, the vehicle instrument panel 196 may communicate audio messages to the operator without display. Further, the sensor(s) 199 may include a vertical accelerometer to indicate road roughness. These devices may be connected to control system 190. In one example, the control system may adjust engine output and/or the wheel brakes to increase vehicle stability in response to sensor(s) 199.

FIG. 2 shows a schematic depiction of a vehicle system 206. The vehicle system 206 includes an engine system 208 coupled to an emissions control system 251 and a fuel system 218. Emission control system 251 includes a fuel vapor container or canister 222 which may be used to capture and store fuel vapors. In some examples, vehicle system 206 may be a hybrid electric vehicle system.

The engine system 208 may include an engine 210 having a plurality of cylinders 230. The engine 210 includes an engine intake 223 and an engine exhaust 225. The engine intake 223 includes a throttle 262 fluidly coupled to the engine intake manifold 244 via an intake passage 242. The engine exhaust 225 includes an exhaust manifold 248 leading to an exhaust passage 235 that routes exhaust gas to the atmosphere. The engine exhaust 225 may include one or more emission control devices 270, which may be mounted in a close-coupled position in the exhaust. One or more emission control devices may include a three-way catalyst, lean NOx trap, diesel particulate filter, oxidation catalyst, etc. It will be appreciated that other components may be included in the engine such as a variety of valves and sensors.

An air intake system hydrocarbon trap (AIS HC) 224 may be placed in the intake manifold of engine 210 to adsorb fuel vapors emanating from unburned fuel in the intake manifold, puddled fuel from one or more fuel injectors with undesired fuel outflow, and/or fuel vapors in crankcase ventilation emissions during engine-off periods. The AIS HC may include a stack of consecutively layered polymeric sheets impregnated with HC vapor adsorption/desorption material. Alternately, the adsorption/desorption material may be filled in the area between the layers of polymeric sheets. The adsorption/desorption material may include one or more of carbon, activated carbon, zeolites, or any other HC adsorbing/desorbing materials. When the engine is operational causing an intake manifold vacuum and a resulting airflow across the AIS HC, the trapped vapors may be passively desorbed from the AIS HC and combusted in the engine. Thus, during engine operation, intake fuel vapors are stored and desorbed from AIS HC 224. In addition, fuel vapors stored during an engine shutdown can also be desorbed from the AIS HC during engine operation. In this way, AIS HC 224 may be continually loaded and purged, and the trap may reduce evaporative emissions from the intake passage even when engine 210 is shut down.

Fuel system 218 may include a fuel tank 220 coupled to a fuel pump system 221. The fuel pump system 221 may include one or more pumps for pressurizing fuel delivered to the injectors of engine 210, such as the example injector 266 shown. While only a single injector 266 is shown, additional injectors are provided for each cylinder. All the injectors in the example shown in FIG. 2 inject fuel directly into each cylinder (i.e., direct injection) rather than injecting fuel into or against an intake valve of each cylinder (i.e., port injection), however multiple fuel injector configurations are possible without departing from the scope of the present disclosure. It will be appreciated that fuel system 218 may be a return-less fuel system, a return fuel system, or various other types of fuel system. Fuel tank 220 may hold a plurality of fuel blends, including fuel with a range of alcohol concentrations, such as various gasoline-ethanol blends, including E10, E85, gasoline, etc., and combinations thereof. A fuel level sensor 234 located in fuel tank 220 may provide an indication of the fuel level ("Fuel Level Input") to controller 212. As depicted, fuel level sensor 234 may comprise a float connected to a variable resistor. Alternatively, other types of fuel level sensors may be used. In some examples, a temperature sensor 236 is positioned within fuel tank 220, to measure fuel temperature. Though only one temperature sensor 236 is shown, multiple sensors may be employed. In some examples, an average of the temperature values detected by those sensors can be taken to obtain a more precise measure of the temperature within the interior of the fuel tank 220. All such temperature sensors are configured to provide an indication of fuel temperature to controller 212.

Vapors generated in fuel system 218 may be routed to an evaporative emissions control system 251 which includes a fuel vapor canister 222 via vapor recovery line 231, before being purged to the engine intake 223. Vapor recovery line 231 may be coupled to fuel tank 220 via one or more conduits and may include one or more valves for isolating the fuel tank during certain conditions. For example, vapor recovery line 231 may be coupled to fuel tank 220 via one or more or a combination of conduits 271, 273, and 275.

Further, in some examples, one or more fuel tank vent valves in conduits 271, 273, or 275. Among other functions, fuel tank vent valves may allow a fuel vapor canister of the emissions control system to be maintained at a low pressure or vacuum without increasing the fuel evaporation rate from the tank (which would otherwise occur if the fuel tank pressure were lowered). For example, conduit 271 may include a grade vent valve (GVV) 287, conduit 273 may include a fill limit venting valve (FLVV) 285, and conduit 275 may include a grade vent valve (GVV) 283. Further, in some examples, recovery line 231 may be coupled to a fuel filler system 219. In some examples, fuel filler system may include a fuel cap 205 for sealing off the fuel filler system from the atmosphere. Refueling system 219 is coupled to fuel tank 220 via a fuel filler pipe or neck 211.

Further, refueling system 219 may include refueling lock 245. In some embodiments, refueling lock 245 may be a fuel cap locking mechanism. The fuel cap locking mechanism may be configured to automatically lock the fuel cap in a closed position so that the fuel cap cannot be opened. For example, the fuel cap 205 may remain locked via refueling lock 245 while pressure or vacuum in the fuel tank is greater than a threshold. In response to a refuel request, e.g., a vehicle operator initiated request, the fuel tank may be depressurized and the fuel cap unlocked after the pressure or vacuum in the fuel tank falls below a threshold. A fuel cap locking mechanism may be a latch or clutch, which, when engaged, prevents the removal of the fuel cap. The latch or clutch may be electrically locked, for example, by a solenoid, or may be mechanically locked, for example, by a pressure diaphragm.

In some embodiments, refueling lock 245 may be a filler pipe valve located at a mouth of fuel filler pipe 211. In such embodiments, refueling lock 245 may not prevent the removal of fuel cap 205. Rather, refueling lock 245 may prevent the insertion of a refueling pump into fuel filler pipe 211. The filler pipe valve may be electrically locked, for example by a solenoid, or mechanically locked, for example by a pressure diaphragm.

In some embodiments, refueling lock 245 may be a refueling door lock, such as a latch or a clutch which locks a refueling door located in a body panel of the vehicle. The refueling door lock may be electrically locked, for example by a solenoid, or mechanically locked, for example by a pressure diaphragm.

In embodiments where refueling lock 245 is locked using an electrical mechanism, refueling lock 245 may be unlocked by commands from controller 212, for example, when a fuel tank pressure decreases below a pressure threshold. In embodiments where refueling lock 245 is locked using a mechanical mechanism, refueling lock 245 may be unlocked via a pressure gradient, for example, when a fuel tank pressure decreases to atmospheric pressure.

Emissions control system 251 may include one or more emissions control devices, such as one or more fuel vapor canisters 222 filled with an appropriate adsorbent, the canisters are configured to temporarily trap fuel vapors (including vaporized hydrocarbons) during fuel tank refilling operations and "running loss" (that is, fuel vaporized during vehicle operation). In one example, the adsorbent used is activated charcoal. Emissions control system 251 may further include a canister ventilation path or vent line 227 which may route gases out of the canister 222 to the atmosphere when storing, or trapping, fuel vapors from fuel system 218.

Canister 222 may include a buffer 222*a* (or buffer region), each of the canister and the buffer comprising the adsorbent. As shown, the volume of buffer 222*a* may be smaller than (e.g., a fraction of) the volume of canister 222. The adsorbent in the buffer 222*a* may be same as, or different from, the adsorbent in the canister (e.g., both may include charcoal). Buffer 222*a* may be positioned within canister 222 such that during canister loading, fuel tank vapors are first adsorbed within the buffer, and then when the buffer is saturated, further fuel tank vapors are adsorbed in the canister. In comparison, during canister purging, fuel vapors are first desorbed from the canister (e.g., to a threshold amount) before being desorbed from the buffer. In other words, loading and unloading of the buffer is not linear with the loading and unloading of the canister. As such, the effect of the canister buffer is to dampen any fuel vapor spikes flowing from the fuel tank to the canister, thereby reducing the possibility of any fuel vapor spikes going to the engine. One or more temperature sensors 232 may be coupled to and/or within canister 222. As fuel vapor is adsorbed by the adsorbent in the canister, heat is generated (heat of adsorption). Likewise, as fuel vapor is desorbed by the adsorbent in the canister, heat is consumed. In this way, the adsorption and desorption of fuel vapor by the canister may be monitored and estimated based on temperature changes within the canister.

Vent line 227 may also allow fresh air to be drawn into canister 222 when purging stored fuel vapors from fuel system 218 to engine intake 223 via purge line 228 and purge valve 261. For example, purge valve 261 may be normally closed but may be opened during certain conditions so that vacuum from engine intake manifold 244 is provided to the fuel vapor canister for purging. In some examples, vent line 227 may include an air filter 259 disposed therein upstream of a canister 222.

In some examples, the flow of air and vapors between canister 222 and the atmosphere may be regulated by a canister vent valve 297 coupled within vent line 227. When included, the canister vent valve may be a normally open valve, so that fuel tank isolation valve 252 (FTIV), if included, may control venting of fuel tank 220 with the atmosphere. FTIV 252, when included, may be positioned between the fuel tank and the fuel vapor canister within conduit 278. FTIV 252 may be a normally closed valve, that when opened, allows for the venting of fuel vapors from fuel tank 220 to canister 222. Fuel vapors may then be vented to atmosphere, or purged to engine intake system 223 via canister purge valve 261.

Fuel system 218 may be operated by controller 212 in a plurality of modes by selective adjustment of the various valves and solenoids. For example, the fuel system may be operated in a fuel vapor storage mode (e.g., during a fuel tank refueling operation and with the engine not running), wherein the controller 212 may open isolation valve 252, if included, while closing canister purge valve (CPV) 261 to direct refueling vapors into canister 222 while preventing fuel vapors from being directed into the intake manifold.

As another example, the fuel system may be operated in a refueling mode (e.g., when fuel tank refueling is requested by a vehicle operator), wherein the controller 212 may open isolation valve 252, if included, while maintaining canister purge valve 261 closed, to depressurize the fuel tank before allowing enabling fuel to be added therein. As such, isolation valve 252, if included, may be kept open during the refueling operation to allow refueling vapors to be stored in the canister. After refueling is completed, the isolation valve, if included, may be closed.

As yet another example, the fuel system may be operated in a canister purging mode (e.g., after an emission control device light-off temperature has been attained and with the engine running), wherein the controller 212 may open canister purge valve 261 while closing isolation valve 252, if included. Herein, the vacuum generated by the intake manifold of the operating engine may be used to draw fresh air through vent line 227 and through fuel vapor canister 222 to purge the stored fuel vapors into intake manifold 244. In this mode, the purged fuel vapors from the canister are combusted in the engine. The purging may be continued until the stored fuel vapor amount in the canister is below a threshold.

Controller 212 may comprise a portion of a control system 214. Control system 214 is shown receiving information from a plurality of sensors 216 (various examples of which are described herein) and sending control signals to a plurality of actuators 281 (various examples of which are described herein). As one example, sensors 216 may include exhaust gas sensor 237 located upstream of the emission control device, temperature sensor 233, temperature sensor 236, pressure sensor 291, and canister temperature sensor 232. Exhaust gas sensor 237 may be any suitable sensor for providing an indication of exhaust gas air/fuel ratio such as a linear oxygen sensor or UEGO (universal or wide-range exhaust gas oxygen), a two-state oxygen sensor or EGO, a HEGO (heated EGO), a NOx, HC, or CO sensor. Other sensors such as pressure, temperature, and composition sensors may be coupled to various locations in the vehicle system 206. As another example, the actuators may include fuel injector 266, throttle 262, fuel tank isolation valve 252 (if included), pump 292, canister vent valve 297, canister purge valve 261, and refueling lock 245. The control system 214 may include a controller 212. The controller may receive input data from the various sensors, process the input data, and trigger the actuators in response to the processed input data based on instruction or code programmed therein corresponding to one or more routines. An example control routine is described herein with regard to FIG. 3.

In some examples, the controller may be placed in a reduced power mode or sleep mode, wherein the controller maintains essential functions only, and operates with a lower battery consumption than in a corresponding awake mode. For example, the controller may be placed in a sleep mode following a vehicle-off event in order to perform a diagnostic routine at a duration after the vehicle-off event. The controller may have a wake input that allows the controller to be returned to an awake mode based on an input received from one or more sensors. For example, the opening of a vehicle door may trigger a return to an awake mode.

Evaporative emissions detection routines may be intermittently performed by controller 212 on fuel system 218 and evaporative emissions control system 251 to confirm that the fuel system and/or evaporative emissions control system are not compromised. As such, evaporative emissions detection routines may be performed while the engine is off (engine-off evaporative emissions test) using engine-off natural vacuum (EONV) generated due to a change in temperature and pressure at the fuel tank following engine shutdown and/or with vacuum supplemented from a vacuum pump. Alternatively, evaporative emissions detection routines may be performed while the engine is running by operating a vacuum pump and/or using engine intake manifold vacuum. Evaporative emissions tests may be performed by an evaporative level check monitor (ELCM) 295 communicatively coupled to controller 212. ELCM 295 may be coupled in vent 227, between canister 222 and the atmosphere. ELCM 295 may include a vacuum pump for applying negative pressure to the fuel system when administering an evaporative emissions test. In some embodiments, the vacuum pump may be configured to be reversible. In other words, the vacuum pump may be configured to apply either a negative pressure or a positive pressure on the fuel system. ELCM 295 may further include a reference orifice and a pressure sensor 296. Following the applying of vacuum to the fuel system, a change in pressure at the reference orifice (e.g., an absolute change or a rate of change) may be monitored and compared to a threshold. Based on the comparison, fuel system degradation may be diagnosed. In another approach, the negative pressure may be applied by coupling the vacuum pump to canister vent line 227.

In some configurations, a canister vent valve (CVV) 297 may be coupled within vent line 227. CVV 297 may function to adjust a flow of air and vapors between canister 222 and the atmosphere. The CVV may also be used for diagnostic routines. When included, the CVV may be opened during fuel vapor storing operations (for example, during fuel tank refueling and while the engine is not running) so that air, stripped of fuel vapor after having passed through the canister, can be pushed out to the atmosphere. Likewise, during purging operations (for example, during canister regeneration and while the engine is running), the CVV may be opened to allow a flow of fresh air to strip the fuel vapors stored in the canister. In some examples, CVV 297 may be a solenoid valve wherein opening or closing of the valve is performed via actuation of a canister vent solenoid. In particular, the canister vent valve may be a normally open valve that is closed upon actuation of the canister vent solenoid. In some examples, CVV 297 may be configured as a latchable solenoid valve. In other words, when the valve is placed in a closed configuration, it latches closed without requiring additional current or voltage. For example, the valve may be closed with a 100 ms pulse, then opened at a later time point with another 100 ms pulse. In this way, the amount of battery power required to maintain the CVV closed is reduced. In particular, the CVV may be closed while the vehicle is off, thus maintaining battery power while maintaining the fuel emissions control system sealed from atmosphere.

Turning now to FIG. 3, a flow chart for a high level example method 300 for conducting an evaporative emission test during a vehicle engine remote start, is shown. More specifically, method 300 may be used to indicate a vehicle engine remote start event and enable an evaporative emissions test responsive to further indication that fuel temperature is stable (e.g., no vaporization), that the vehicle is not occupied, and that doors and/or the trunk are not opened during the course of the emissions test. By enabling an evaporative emissions test to be conducting during a remote engine start, the evaporative emissions test monitor may be enabled sooner in the drive cycle and under conditions wherein the test is likely to be completed. Method 300 will be described with reference to the systems described herein and shown in FIGS. 1-2 though it should be understood that similar methods may be applied to other systems without departing from the scope of this disclosure. Method 300 may be carried out by a controller, such as controller 212 in FIG. 2, and may be stored at the controller as executable instructions in non-transitory memory. Instructions for carrying out method 300 and the rest of the methods included herein may be executed by the controller based on instructions stored on a memory of the controller and in conjunction with signals received from sensors of the vehicle system, such as the seat load cells (e.g., 107), door sensors (e.g., 108), onboard cameras (e.g., 109), remote engine start receiver (e.g., 195), and fuel temperature sensor (e.g., 236), described above with reference to FIG. 1 and FIG. 2. The controller may employ evaporative emissions system actuators such as the canister purge valve (e.g., 261), canister vent valve (e.g., 297), fuel tank isolation valve (e.g., 252) (if included), and air intake throttle (e.g., 262) to control evaporative emissions testing, according to the method described below. Other engine, fuel system, and evaporative emissions system actuators may additionally be employed according to the method described below.

Method 300 begins at 305 and may include evaluating current operating conditions. Operating conditions may be estimated, measured, and/or inferred, and may include one or more vehicle conditions, such as vehicle speed, vehicle location, etc., various engine conditions, such as engine status, engine load, engine speed, A/F ratio, etc., various fuel system conditions, such as fuel level, fuel type, fuel temperature, etc., various evaporative emissions system conditions, such as fuel vapor canister load, fuel tank pressure, etc., as well as various ambient conditions, such as ambient temperature, humidity, barometric pressure, etc. Continuing at 310, method 300 may include indicating whether a vehicle remote start is indicated. For example, upon actuation of a remote start button (e.g., 105) on a key fob (e.g., 104), a remote signal may be transmitted from the fob and, if within range, received by a remote engine start receiver (e.g., 195) in the vehicle. Upon receiving the remote signal, the engine start receiver may alert the vehicle controller to start the engine. In other examples a remote start may be initiated via a cellular telephone, or smartphone based system where a user's cellular telephone sends data to a server and the server communicates with the vehicle to start the engine. If, at 310 a remote engine start is not indicated, method 300 may proceed to 315 and may include maintaining the status of the engine, exhaust, and emissions control systems. For example, the engine may be maintained off, and the canister purge valve may be maintained closed. Further, in some examples if the vehicle is a plug-in hybrid electric vehicle (PHEV) with a steel fuel tank, a fuel tank isolation valve may be maintained closed, and the canister vent valve maintained in its default vehicle off state. Alternatively, if the vehicle is not a PHEV, yet comprises a fuel tank isolation valve to isolate the fuel system from the evaporative emissions control system, the fuel tank isolation valve may be maintained open during the vehicle off condition, and the canister vent valve may similarly be maintained open. In a vehicle without a fuel tank isolation valve, the canister vent valve may be maintained open during the vehicle off condition. Method 300 may then end.

Returning to 310, if a remote engine start is indicated, method 300 may proceed to 320. At 320, method 300 may include indicating whether entry conditions for a remote start evaporative emissions test are met. Entry conditions for a remote start evaporative emissions test may include indicating that the vehicle is not occupied based on sensor output from seat load cells (e.g., 107), and/or onboard cameras (e.g., 109). Entry conditions for a remote start evaporative emissions test may further include indicating that the doors and/or trunk of the vehicle are closed via door sensing technology (e.g., 108) and/or onboard cameras. Entry conditions for a remote start evaporative emissions test may further include indicating that fuel temperature is stable and below a threshold fuel temperature, and may include indicating a fuel temperature as measured by a fuel temperature sensor (e.g., 236). In some examples, fuel temperature may be inferred based on an engine-off duration, and may further be based on ambient temperature. If, at 320, it is indicated that entry conditions for a remote engine start evaporative emissions test are not met, method 300 may proceed to 325. At 325, method 300 may include setting a flag at the controller to indicate that a remote engine start was initiated, but that entry conditions for a remote engine start evaporative emissions test were not met. At 325, setting a flag may further include scheduling an evaporative emissions test at the next subsequent remote engine start event. Proceeding to 330, method 300 may include updating fuel system and evaporative emissions system status. For example, updating fuel system and evaporative emissions system status at 330 may include scheduling an evaporative emissions test at the next opportunity, in light of the indication that a remote engine start event was indicated but that an evaporative emissions test was not conducted. Method 300 may then end.

Returning to 320, if it is indicated that entry conditions for a remote engine start evaporative emissions test are met, method 300 may proceed to 335. At 335, method 300 may include sealing the vehicle fuel system and evaporative emissions system from atmosphere. Sealing the vehicle fuel system and evaporative emissions system from atmosphere may include maintaining a canister purge valve (e.g., 261) closed, and closing a canister vent valve (e.g., 297). Furthermore, if the vehicle includes a fuel tank isolation valve, the fuel tank isolation valve may be commanded open or maintained open. In some examples, if the vehicle includes a fuel tank isolation valve and the fuel tank isolation valve was closed, then prior to closing the canister vent valve, the fuel tank isolation valve may be commanded open, and the fuel tank depressurized. Following fuel tank depressurization, the fuel tank isolation valve may be maintained open, and the canister vent valve may be commanded closed, thus sealing the fuel system and evaporative emissions system. In still other examples, if the vehicle comprises a PHEV with a steel fuel tank, the fuel tank isolation valve may be maintained closed, and closing the canister vent valve may thus seal the evaporative emissions control system from atmosphere. In such a case, only the evaporative emissions control system may be checked for undesired emissions during a remote engine start evaporative emissions test, as described in further detail below. As a sealed steel fuel tank will hold pressure and/or vacuum, other methodologies may be utilized to infer whether undesired evaporative emissions are present in the fuel system, for example monitoring pressure during diurnal temperature cycles, as is known in the art. In a case where the vehicle does not include a fuel tank isolation valve, or in a case where the fuel tank isolation valve is open, it may be understood that the fuel system and evaporative emissions systems are fluidically coupled.

Proceeding to 340, method 300 may include coupling the evaporative emissions system and fuel system to engine intake. As such, at 340, method 300 includes commanding closed or maintaining closed an air intake throttle, and commanding open the canister purge valve. Engine operation with the throttle closed creates an intake manifold vacuum with respect to atmospheric pressure. By commanding open the canister purge valve, with the air intake throttle closed, engine intake manifold vacuum may be applied to the evaporative emissions system and fuel system, provided that the fuel tank isolation valve, if included, is commanded open. As described above, in some examples the fuel tank isolation valve may be maintained closed, and as such commanding open the canister purge valve may thus direct engine intake manifold vacuum to the evaporative emissions control system, and not to the fuel system. In either case, commanding open the canister purge valve may direct engine intake manifold vacuum to the fuel vapor canister (e.g., 222), and as such fuel vapors may be desorbed from the fuel vapor canister and routed to engine intake for combustion. In some examples, desorption of fuel vapors from the fuel vapor canister may result in rich canister vapors entering the intake, and may result in engine stumbles and/or hesitations due to the alteration in air/fuel ratio. However, as the vehicle is not occupied, any engine stumbles and/or hesitations from opening the canister purge valve are not experienced by the vehicle operator and/or passengers. As such, the evaporative emissions test may execute without dissatisfaction to the vehicle operator and/or passengers. Furthermore, as opening the canister purge valve may result in fuel vapors being desorbed from the fuel vapor canister, while the canister purge valve is open and engine intake manifold vacuum is being applied to the fuel system and/or evaporative emissions system, canister load may be monitored. In one example, canister load may be monitored by temperature sensors positioned within the fuel vapor canister, such as temperature sensor 232. As the process of hydrocarbon desorption is endothermic, as hydrocarbons are desorbed from the fuel vapor canister, temperature may decrease in the vicinity of the desorbed hydrocarbons. In this way, canister load may be monitored while the canister purge valve is open, and subsequent to the canister purge valve closing (described in further detail below), the canister loading state may be updated.

Proceeding to 345, method 300 includes indicating whether pressure in the evaporative emissions control system and fuel system (if the fuel tank isolation valve is open, or not included), or if pressure in the evaporative emissions control system (if the fuel tank isolation valve is maintained closed), is below a predetermined negative pressure threshold. The predetermined negative pressure threshold may comprise a negative pressure with respect to atmospheric pressure, the predetermined negative pressure threshold based on a difference from atmospheric pressure sufficient to monitor a subsequent pressure increase rate, described in further detail below.

For example, vacuum from the engine intake manifold may be applied to the evaporative emissions system and fuel system, or evaporative emissions system alone, until the predetermined threshold negative pressure level has been reached. If, at 345, the predetermined threshold negative pressure level has not been reached, method 300 may proceed to 346. At 346, method 300 may include indicating whether pressure in the evaporative emissions system and fuel system, or evaporative emissions system alone, has reached a plateau without reaching the predetermined threshold negative pressure level. If, at 346, a pressure plateau is not indicated, method 300 may continue to couple the evaporative emissions system and fuel system, or the evaporative emissions system alone, to engine intake manifold to continue applying vacuum on the fuel system and/or evaporative emissions system. Alternatively, responsive to an indication that pressure in the fuel system and/or evaporative emissions system reached a plateau prior to reaching the predetermined negative pressure threshold, method 300 may proceed to 375 and may include recording a failing test result. For example, as engine intake manifold vacuum was applied to the fuel system and/or evaporative emissions system, yet pressure in the fuel system and/or evaporative emissions system did not reach the predetermined negative pressure threshold, undesired evaporative emissions may be indicated. In other words, although the method did not proceed to conducting an evaporative emissions test according to method 300, because it was not possible to reach the predetermined negative pressure threshold with applied engine intake manifold vacuum, undesired evaporative emissions may be indicated. In some examples, an inability to reach the predetermined negative pressure threshold may be due to the canister vent valve stuck in an open position. As such, undesired evaporative emissions may escape through the stuck open canister vent valve under some circumstances, such as a conditions where a fuel vapor canister is loaded with fuel vapors and bleed-through emissions result. Other examples include undesired emissions stemming from a source location other than the canister vent valve in the fuel system and/or evaporative emissions system.

Proceeding to 380, method 300 may include taking an action responsive to the indication of undesired evaporative emissions, where the source of undesired evaporative emissions is such that engine intake manifold vacuum was unable to lower vacuum in the fuel system and/or evaporative emissions system to the predetermined negative pressure threshold. For example, taking an action may include updating a canister purge schedule, where updating the canister purge schedule may include performing purge operations more frequently such that fuel vapor in the fuel system and/or evaporative emissions system may be effectively routed to the engine for combustion, rather than escaping to the atmosphere. In other examples, purging operations may be suspended until it is indicated that the source of undesired evaporative emissions has been mitigated. However, the above examples represent just two possibilities, and in no way are the above examples meant to be limiting in any way. Continuing to 385, method 300 may include commanding closed the canister purge valve, and commanding open the canister vent valve. In this way, the fuel system and/or evaporative emissions system may be sealed from engine intake, and pressure in the fuel system and/or evaporative emissions system may be returned to atmospheric pressure. In an example where the vehicle included a fuel tank isolation valve, and the fuel tank isolation valve was maintained closed during applying negative pressure to the fuel system and/or evaporative emissions system, the fuel tank isolation valve may be continued to be maintained closed. In another example, where the fuel tank isolation valve was maintained open during applying negative pressure to the fuel system and/or evaporative emissions system, the fuel tank isolation valve may be maintained open during engine operation such that running loss vapors may be routed to the fuel vapor canister where they may be adsorbed therein. Alternatively, if the vehicle comprises a PHEV with a steel fuel tank, if the fuel tank isolation valve was maintained open during applying negative pressure to the fuel system and/or evaporative emissions system, the fuel tank isolation may be commanded closed.

Proceeding to 390, method 300 may include updating an evaporative emissions test schedule responsive to the indication of the presence of undesired evaporative emissions. In one example, updating the evaporative emissions test schedule at 390 may include suspending scheduled evaporative emissions tests until it is indicated that the source of undesired evaporative emissions has been mitigated. In another example, updating the evaporative emissions test schedule may include scheduling evaporative emissions tests that may isolate further the source of undesired evaporative emissions. For example, if engine intake manifold vacuum was applied to both the fuel system and evaporative emissions system, a future test may be scheduled on the evaporative emissions system alone, provided that the vehicle is equipped with a fuel tank isolation valve to isolate the fuel system from the evaporative emissions system. If engine intake manifold vacuum is able to lower pressure in the evaporative emissions system to the predetermined negative pressure threshold with the fuel tank isolation valve closed, then it may be indicated that the source of undesired evaporative emissions stems from the fuel system. Furthermore, method 300 may be used to indicate whether undesired evaporative emissions are further indicated in the evaporative emissions system responsive to the ability of engine intake manifold vacuum t lower pressure in the evaporative emissions system to the predetermined negative pressure threshold, as described in further detail below. Method 300 may then end.

Returning to 345, if pressure in the fuel system and/or evaporative emissions system is indicated to reach the predetermined negative pressure threshold, method 300 may proceed to 350. At 350, method 300 may include sealing the fuel system and/or evaporative emissions system from engine intake by commanding closed the canister purge valve. For example, if the fuel tank isolation valve was maintained open while the canister purge valve was maintained open, then commanding closed the canister purge valve may seal the fuel system and evaporative emissions system from engine intake and atmosphere. Alternatively, if the fuel tank isolation valve was maintained closed while the canister purge valve was maintained open, then commanding closed the canister purge valve may seal the evaporative emissions system from engine intake and atmosphere.

Proceeding to 355, method 300 includes conducting the evaporative emissions test diagnostic. For example, pressure in the fuel system and/or evaporative emissions system may be monitored, and based on a pressure increase rate (e.g., bleed-up rate), the presence or absence of undesired evaporative emissions may be determined. In one example, a predetermined pressure threshold may be set (e.g., atmospheric pressure), and responsive to pressure in the fuel system and/or evaporative emissions system not reaching the predetermined pressure threshold in a predetermined duration, an absence of undesired evaporative emissions may be indicated. In other words, undesired evaporative emissions may be indicated responsive to a pressure increase rate in the fuel system and evaporative emissions system greater than a threshold pressure increase rate, subsequent to the predetermined negative pressure threshold being reached and the fuel system and/or evaporative emissions system sealed from vacuum in the intake manifold. Furthermore, it may be understood that a pressure increase rate greater than the threshold pressure increase rate indicates undesired evaporative emissions escaping through a source of at least a defined area. As described above, if the fuel tank isolation valve is open, the evaporative emissions test may diagnose both the fuel system and evaporative emissions system for undesired evaporative emissions. Alternatively, if the fuel tank isolation valve is maintained closed, the evaporative emissions test may diagnose only the evaporative emissions system for undesired evaporative emissions. In some examples, depending on whether the fuel tank isolation valve is open or closed during the evaporative emissions test, the evaporative emissions test duration may be adjusted, and/or the predetermined pressure threshold (pressure increase rate) may be adjusted. For example, the time duration of the evaporative emissions test may be shortened responsive to an evaporative emissions test on the evaporative emissions system, and not the fuel system, as compared to a time duration for an evaporative emissions test on the fuel system and evaporative emissions system.

Proceeding to 360, method 300 includes indicating whether vehicle access is attempted during the evaporative emissions test procedure. For example, an attempt to access the vehicle may result in sufficient noise during the evaporative emissions test to render the test unreliable. In one example, wherein the evaporative emissions test comprises the fuel system and evaporative emissions system, attempted vehicle access may result in significant fuel sloshing events that may increase pressure in the fuel system and evaporative emissions system, thus potentially resulting in a false failure. In another example, wherein the evaporative emissions test comprises the evaporative emissions system, and not the fuel system, attempted vehicle access may result in noise in the system such that the outcome of the test is unreliable. As such, if, at 360 it is indicated that vehicle access is attempted, wherein vehicle access may include opening of one or more vehicle doors indicated by door sensors (e.g., door sensing technology 108), occupying the vehicle indicated by seat load cells (e.g., 107), or any of the above indicated by onboard cameras (e.g., 109), method 300 may proceed to 365 and may include aborting the evaporative emissions test. Furthermore, if fuel temperature is indicated to have risen above the fuel temperature threshold described above, where fuel may readily vaporize, the evaporative emissions test may similarly be aborted. While method 300 depicts indicating whether vehicle access is attempted at 360, it should be understood that, if vehicle access or fuel temperature increases above the threshold fuel temperature at any time subsequent to indicating that entry conditions for the evaporative emissions test are met, method 300 may proceed to 365 and may include aborting the method. Aborting the method at 365 may include sealing or maintaining sealed the fuel system and/or evaporative emissions system from vacuum in the intake manifold, maintaining engine operation, and unsealing the fuel system and/or evaporative emissions system from atmosphere by commanding open the canister vent valve. In an example where the vehicle included a fuel tank isolation valve, and the fuel tank isolation valve was maintained closed, the fuel tank isolation valve may be continued to be maintained closed. In another example, where the fuel tank isolation valve was maintained open subsequent to sealing the fuel system and evaporative emissions system from atmosphere at 335, the fuel tank isolation valve may be maintained open during engine operation such that running loss vapors may be routed to the fuel vapor canister where they may be adsorbed therein. Alternatively, if the vehicle comprises a PHEV with a steel fuel tank, if the fuel tank isolation valve was maintained open subsequent to sealing the fuel system and evaporative emissions system from atmosphere at 335, the fuel tank isolation may be commanded closed. Furthermore, at 365, method 300 may include setting a flag to indicate that an evaporative emissions test was initiated, but was aborted during the course of the test procedure. At 365, setting a flag may further include scheduling an evaporative emissions test at the next subsequent remote start event. Proceeding to 367, method 300 may include updating fuel system and evaporative emissions system status. For example, updating fuel system and evaporative emissions system status at 367 may include scheduling an evaporative emissions test at the next opportunity where entry conditions for an evaporative emissions test are met, in light of the indication that an evaporative emissions test was initiated but that the test was aborted. Method 300 may then end.

Returning to 360, if attempted vehicle access is not indicated, method 300 may proceed to 370. At 370, method 300 may include determining whether undesired evaporative emissions are indicated. As described above, during the evaporative emissions test, pressure in the fuel system and/or evaporative emissions system may be monitored, and based on a rate of pressure bleed-up, the presence or absence of undesired evaporative emissions may be determined. For example, if, during a predetermined duration of time allotted for the evaporative emissions test, pressure in the fuel system and/or evaporative emissions system remains below a predetermined pressure threshold, an absence of undesired evaporative emissions may be indicated. Alternatively, if the predetermined pressure threshold is reached during the predetermined duration of time allotted for the evaporative emissions test, the presence of undesired evaporative emissions may be indicated. Accordingly, at 370, if undesired evaporative emissions are indicated, method 300 may proceed to 375, and may include recording the presence of undesired evaporative emissions. Proceeding to 380, method 300 may include taking an action responsive to the indication of undesired evaporative emissions. In one example, a canister purge schedule may be updated to perform purge operations more frequently such that fuel vapor in the fuel system and/or evaporative emissions system may be effectively routed to the engine for combustion, rather than escaping to atmosphere. Continuing to 385, method 300 may include commanding open the canister vent valve, and maintaining closed the canister purge valve. In this way, pressure in the fuel system and/or evaporative emissions system may be returned to atmospheric pressure. If the vehicle included a fuel tank isolation valve that was maintained open during the evaporative emissions test procedure, if the vehicle comprises a PHEV with a steel fuel tank the fuel tank isolation valve may be commanded closed. Alternatively, if the vehicle does not include a steel fuel tank, the fuel tank isolation valve may be maintained open during engine operation such that running loss vapors may be routed to the fuel vapor canister where they may be adsorbed therein. If the vehicle included a fuel tank isolation valve that was maintained closed during the evaporative emissions test procedure, and the vehicle comprises a PHEV with a steel fuel tank, the fuel tank isolation valve may be maintained closed. Alternatively, if the vehicle does not include a steel fuel tank, the fuel tank isolation valve may be commanded open during engine operation such that running loss vapors may be routed to the fuel vapor canister where they may be adsorbed therein.

Proceeding to 390, method 300 may include updating an evaporative emissions test schedule responsive to the indication of the presence of undesired evaporative emissions. In one example, updating the evaporative emissions test schedule at 390 may include suspending scheduled evaporative emissions tests until it is indicated that the source of undesired evaporative emissions has been mitigated. In other examples, updating the evaporative emissions test schedule may include scheduling evaporative emissions tests that may isolate further the source of undesired evaporative emissions. For example, if the evaporative emissions test was conducted on the fuel system and evaporative emissions system, rather than the evaporative emissions system alone, a future evaporative emissions test may be scheduled on the evaporative emission system alone, provided that the vehicle is equipped with a fuel tank isolation valve to isolate the fuel system from evaporative emissions system. By conducting a future evaporative emissions test on the evaporative emissions system in isolation from the fuel system, it may be indicated whether the source of undesired evaporative emissions stems from the fuel system, or the evaporative emissions system. Method 300 may then end.

Returning to 370, if undesired evaporative emissions are not indicated, method 300 may proceed to 395 and may include recording the absence of undesired evaporative emissions. Continuing to 385, method 300 may include commanding open the canister vent valve and maintaining closed the canister purge valve. In this way, pressure in the fuel system and/or evaporative emissions system may be returned to atmospheric pressure. As described above, if the vehicle included a fuel tank isolation valve that was maintained open during the evaporative emissions test procedure, if the vehicle comprises a PHEV with a steel fuel tank the fuel tank isolation valve may be commanded closed. Alternatively, if the vehicle does not include a steel fuel tank, the fuel tank isolation valve may be maintained open during engine operation such that running loss vapors may be routed to the fuel vapor canister where they may be adsorbed therein. If the vehicle included a fuel tank isolation valve that was maintained closed during the evaporative emissions test procedure, and the vehicle comprises a PHEV with a steel fuel tank, the fuel tank isolation valve may be maintained closed. Alternatively, if the vehicle does not include a steel fuel tank, the fuel tank isolation valve may be commanded open during engine operation such that running loss vapors may be routed to the fuel vapor canister where they may be adsorbed therein.

Continuing to 390, method 300 may include updating the evaporative emissions test schedule to reflect the passing result. For example, scheduled evaporative emissions tests during vehicle operation may be rescheduled for a later time, as a result of the indication of the absence of undesired evaporative emissions. Method 300 may then end.

FIG. 4 shows an example timeline 400 for conducting an evaporative emission test diagnostic during a vehicle engine remote start event according to the method described herein and with reference to FIG. 3, and as applied to the systems described herein and with reference to FIGS. 1-2. Timeline 400 includes plot 405, indicating the on or off status of a vehicle engine, over time. Timeline 400 further includes plot 410, indicating whether the vehicle is occupied, over time. Whether a vehicle is occupied may be indicated via seat load cells (e.g., 107), or via onboard cameras (e.g., 109), for example. Timeline 400 further includes plot 415, indicating whether the vehicle doors and/or trunk are in a closed or open state, over time. For example, indicating the open or closed status of the vehicle doors and/or trunk may be accomplished via door sensing technology (e.g., 108), and/or onboard cameras (e.g., 109). Timeline 400 further includes plot 420, indicating a fuel temperature, over time, and may include indicating fuel temperature via a fuel temperature sensor (e.g., 236). Line 423 represents a threshold fuel temperature, above which significant fuel vaporization may be indicated. Timeline 400 further includes plot 425, indicating the open or closed status of a canister vent valve (CVV), and plot 430, indicating the open or closed status of a canister purge valve (CPV), over time. Timeline 400 further includes plot 435, indicating a fuel vapor canister loading state, over time. In some examples, canister loading state may be indicated via a one or more temperature sensor(s) (e.g., 232) positioned within the fuel vapor canister (e.g., 222). Timeline 400 further includes plot 440, indicating a position of an air intake throttle (e.g., 262), over time. Timeline 400 further includes plot 445, indicating fuel system and evaporative emissions system pressure, over time. As described in detail above, in some examples a fuel tank isolation valve (e.g., 252) may be included in the vehicle, which may in some cases be maintained closed to isolate the fuel system from the evaporative emissions system. However, this example illustration depicts a vehicle without a fuel tank isolation valve, or if included, it may be understood that the fuel tank isolation valve is maintained open during the course of timeline 400. As such, fuel tank isolation valve status is not included in example timeline 400. Accordingly, fuel system and evaporative emissions system pressure may be indicated via a fuel tank pressure transducer (e.g., 291). Line 447 represents a predetermined negative pressure threshold, wherein responsive to pressure in the fuel system and evaporative emissions system reaching the predetermined negative pressure threshold, the evaporative emissions test may be conducted. Line 449 represents a predetermined pressure threshold, wherein responsive to pressure in the fuel system and evaporative emissions system not bleeding-up to the predetermined pressure threshold during a duration of the evaporative emissions test, an absence of undesired evaporative emissions may be indicated, as described above and which will be described in further detail below. Timeline 400 further includes plot 450, indicating whether undesired evaporative emissions are indicated, over time.

At time $t_0$, the vehicle engine is off, indicated by plot 405. The vehicle is not occupied, indicated by plot 410, the doors/trunk of the vehicle are closed, indicated by plot 415, and fuel temperature, indicated by plot 420, is below the threshold fuel temperature, represented by line 423. Accordingly, the canister vent valve is open, indicated by plot 425, and the canister purge valve is closed, indicated by plot 430. The fuel vapor canister is nearly full of hydrocarbons, indicated by plot 435. The throttle is in a default engine off position, indicated by plot 440. Pressure in the fuel system and evaporative emissions system, indicated by plot 445, is at atmospheric pressure, as the canister vent valve is open and fuel temperature is stable and below the threshold fuel temperature. Furthermore, undesired evaporative emissions in the fuel system and evaporative emissions system are not indicated, as illustrated by plot 450.

At time $t_1$, a remote start of the engine is initiated. As described above, a remote start of the engine may be initiated via actuation of a remote start button on a key fob, wherein a remote signal may be transmitted from the fob, received by a remote engine start receiver, and where the remote engine start receiver subsequently alerts the vehicle controller to start the engine. Other examples may include a remote start initiated via a smartphone configured to communicate with the vehicle to start the engine. As a remote start is initiated at time $t_1$, it may be indicated whether entry conditions are met for an evaporative emissions test. As described above, entry conditions may include indicating that the vehicle is not occupied based on sensor output from seat load cells (e.g., 107), and/or onboard cameras (e.g., 109), indicating that the doors and/or trunk of the vehicle are closed via door sensing technology (e.g., 108), and/or onboard cameras (e.g., 109), and indicating that fuel tank temperature is stable and below a threshold temperature, as monitored via a fuel tank temperature sensor (e.g., 236). Accordingly, at time $t_1$, it may be indicated that entry conditions for an evaporative emissions test are met, as the vehicle is indicated to be unoccupied, with doors/trunk closed, and fuel temperature below the threshold fuel temperature.

As entry conditions for an evaporative emissions test are met, at time $t_2$ the canister vent valve is commanded closed while maintaining the canister purge valve closed, thus sealing the vehicle fuel system and evaporative emissions system from atmosphere. Subsequent to sealing the fuel system and evaporative emissions system from atmosphere, the canister purge valve may be commanded open at time $t_3$, and the throttle commanded to a closed position. By commanding closed the throttle while commanding open the canister purge valve, engine intake manifold vacuum may be coupled to the fuel system and evaporative emissions system. In other words, engine intake manifold vacuum may be selectively coupled to the fuel system and evaporative emissions system via the canister purge valve, with the air intake throttle closed, where the air intake throttle may selectively couple engine intake to atmosphere. With the canister purge valve open and the throttle closed, by applying intake manifold vacuum to the fuel system and evaporative emissions system, pressure in the fuel system and evaporative emissions system may be reduced. Accordingly, between time $t_3$ and $t_4$, pressure in the fuel system and evaporative emissions system, as monitored by a pressure sensor (e.g., 291), is indicated to decrease. Furthermore, as vacuum is applied to the evaporative emissions system, fuel vapors may be desorbed from a fuel vapor canister (e.g., 222) positioned therein. Accordingly, fuel vapor canister load, as monitored by one or more temperature sensors positioned within the fuel vapor canister as described above, is indicated to decrease as fuel vapors are desorbed and routed to the engine intake for combustion.

At time $t_4$, pressure in the fuel system and evaporative emissions system reaches the predetermined negative pressure threshold, represented by line 447. As pressure in the fuel system and evaporative emissions system reached the predetermined negative pressure threshold, the evaporative emissions test may be further conducted. As such, at time $t_4$, the canister purge valve is commanded closed, thus sealing the fuel system and evaporative emissions system from the engine intake manifold vacuum (and atmosphere). Additionally, the throttle may be commanded back to its position prior to being commanded closed such that negative pressure downstream of the canister purge valve does not continue to build.

Between time $t_4$ and $t_5$, with the fuel system and evaporative emissions system sealed from engine intake and atmosphere, pressure in the fuel system and evaporative emissions system rises slightly. However, in the duration comprising time $t_4$ to $t_5$, pressure in the fuel system and evaporative emissions system does not rise to the threshold pressure level, represented by line 447. The duration may comprise a predetermined duration, where a pressure rise to the threshold pressure level indicates undesired evaporative emissions escaping through a source of at least a defined area. As such, at time $t_5$, the evaporative emissions test may be concluded, and an absence of undesired emissions indicated. Accordingly, as the evaporative emissions test is complete, the canister vent valve may be commanded open to unseal the fuel system and evaporative emissions system from atmosphere. As such, between time $t_5$ and $t_6$, pressure in the fuel system and evaporative emissions system returns to atmospheric pressure.

At time $t_6$, it is indicated that one or more of the doors/trunk are opened, indicated by plot 415, and at time $t_7$ the vehicle is indicated to become occupied, indicated by plot 410. At time $t_8$, the vehicle doors/trunk are indicated to be closed, and between time $t_8$ and $t_9$ the vehicle remains parked with the engine on and vehicle cabin occupied by a vehicle operator and/or passengers, prior to initiating a drive cycle.

In this way, an engine-on evaporative emissions test diagnostic procedure may be conducted during a vehicle engine remote start event. In one example, responsive to an indication of a vehicle engine remote start event, it may be indicated whether the vehicle is occupied, whether the doors and/or trunk are open or closed, and whether fuel temperature is stabilized below a threshold fuel temperature. Responsive to an indication that the vehicle is not occupied, the doors/trunk are closed, and fuel tank temperature is stabilized below the threshold, a fuel system and evaporative emissions system of the vehicle may be sealed from atmosphere, and subsequently coupled to engine intake vacuum to reduce pressure in the fuel system and evaporative emissions system to a predetermined negative pressure threshold. Upon reaching the predetermined negative pressure threshold, the fuel system and evaporative emissions system may be sealed from the engine, and a pressure increase rate (bleed-up) monitored. A pressure increase rate greater than a threshold pressure increase rate may indicate the presence of undesired evaporative emissions. If, at any point during the procedure, an attempted access to the vehicle is indicated, or if the vehicle becomes occupied, the evaporative emissions test procedure may be aborted.

The technical effect of conducting an evaporative emissions test diagnostic procedure responsive to an indication of a vehicle engine remote start event is to enable an evaporative emissions test under ideal conditions where external noise factors do not negatively impact the results of the test procedure. For example, an evaporative emissions test relying on engine intake vacuum to reduce pressure in the fuel system and/or evaporative emissions system, and subsequent pressure increase rate to indicate the presence or absence of undesired evaporative emissions is prone to error if the vehicle is not stationary, free of a driver/passengers, and if fuel temperature is not stable and below a threshold for vaporization. As such, a vehicle engine remote start event represents an ideal circumstance for conducting such an evaporative emissions test, as the vehicle is likely to be unoccupied, with fuel temperature stabilized below the threshold, and where the vehicle is stationary. An additional technical effect of conducting an evaporative emissions test diagnostic during a vehicle engine remote start event is to enable engine intake manifold vacuum to be applied to the evaporative emissions system and fuel system prior to initiating a drive cycle. When applying engine intake manifold vacuum to the evaporative emissions system, fuel vapors may be desorbed from a fuel vapor canister positioned therein. Fuel vapors inducted into the engine may result in engine hesitations and/or stumbles, and such hesitations and/or stumbles may be experienced by a vehicle operator and/or passengers, if the vehicle is occupied. As such, by conducting the evaporative emissions test during a remote start event where the vehicle is not occupied, any engine hesitations and/or stumbles resulting from applying engine intake vacuum on the evaporative emissions system will go unnoticed by the vehicle operator and/or passengers. In this way, completion rates for evaporative emissions tests may be increased, undesired evaporative emissions decreased, and customer satisfaction increased.

The systems described herein and with reference to FIGS. 1-2, along with the methods described herein and with reference to FIG. 3, may enable one or more systems and one or more methods. In one example, a method for a vehicle comprises responsive to a command from a location external to the vehicle to start a combustion engine in the vehicle: reducing pressure in a fuel system which supplies fuel to the engine and an evaporative emissions system coupled to the fuel system to a predetermined pressure; and indicating undesired evaporative emissions responsive to a subsequent pressure increase rate in the fuel system and evaporative emissions system greater than a threshold pressure rate. In a first example of the method, the method further includes wherein the engine is started from a location external to the vehicle via one of a key fob configured to transmit a remote signal to a remote engine start receiver in the vehicle, or a smartphone based system where a user's cellular telephone sends data to a server and the server communicates with the vehicle to start the engine. A second example of the method optionally includes the first example and further comprises indicating whether the vehicle is occupied based on one or more of seat load cells, and onboard cameras; indicating whether doors and a trunk of the vehicle are open or closed via one or more of door sensors, and onboard cameras; indicating a fuel temperature via a fuel tank temperature sensor; and wherein reducing pressure in the fuel system and evaporative emissions system is further responsive to an indication that the vehicle is not occupied and one or more of the following: that doors and the trunk of the vehicle are closed, and that the fuel temperature is below a fuel temperature threshold; wherein the fuel temperature threshold comprises fuel temperature where fuel does not readily vaporize. A third example of the method optionally includes any one or more or each of the first and second examples and further comprises sealing the fuel system and evaporative emissions system from atmosphere prior to reducing pressure in the fuel system and evaporative emissions system. A fourth example of the method optionally includes any one or more or each of the first through third examples and further comprises selectively coupling the fuel system and evaporative emissions system to atmosphere via a canister vent valve; wherein sealing the fuel system and evaporative emissions system from atmosphere comprises closing the canister vent valve. A fifth example of the method optionally includes any one or more or each of the first through fourth examples and further includes wherein starting the engine creates an intake manifold vacuum; and wherein reducing pressure in the fuel system and evaporative emissions system comprises applying the intake manifold vacuum to the fuel system and evaporative emissions system. A sixth example of the method optionally includes any one or more or each of the first through fifth examples and further comprises responsive to reaching a predetermined negative pressure threshold, sealing the fuel system and evaporative emissions system from the intake manifold vacuum. A seventh example of the method optionally includes any one or more or each of the first through sixth examples and further comprises selectively coupling the engine intake manifold vacuum to the fuel system and evaporative emissions system via a canister purge valve; selectively coupling engine intake to atmosphere via an air intake throttle; wherein reducing pressure in the fuel system and evaporative emissions system comprises applying the intake manifold vacuum to the fuel system and evaporative emissions by opening the canister purge valve and closing the throttle; and wherein sealing the fuel system and evaporative emissions system from the intake manifold vacuum includes closing the canister purge valve. An eighth example of the method optionally includes any one or more or each of the first through seventh examples and further includes wherein indicating undesired evaporative emissions responsive to a subsequent pressure increase rate in the fuel system and evaporative emissions system greater than a threshold pressure increase rate includes monitoring pressure in the fuel system and evaporative emissions system subsequent to sealing the fuel system and evaporative emissions system from the intake manifold vacuum; and wherein the pressure increase rate greater than the threshold pressure increase rate indicates undesired evaporative emissions escaping through a source of at least a defined area. A ninth example of the method optionally includes any one or more or each of the first through eighth examples and further includes wherein the predetermined negative pressure threshold comprises a negative pressure with respect to atmospheric pressure, the predetermined negative pressure threshold based on a difference from atmospheric pressure sufficient to monitor the subsequent pressure increase rate. A tenth example of the method optionally includes any one or more or each of the first through ninth examples and further comprises prior to indicating a presence or absence of undesired evaporative emissions, and responsive to an indication that the vehicle has become occupied, that door(s) and/or trunk of the vehicle are opened, or that fuel temperature has risen above the threshold fuel temperature, stopping applying the intake manifold vacuum to the fuel system and evaporative emissions system; and unsealing the fuel system and evaporative emissions system from atmosphere.

An example of a system for a vehicle comprises an engine comprising one or more cylinders, each cylinder comprising an intake valve and an exhaust valve; a fuel tank configured within a fuel system; a fuel vapor canister, configured within an evaporative emissions control system, coupled to the fuel tank, coupled to atmosphere via a canister vent valve, and coupled to an engine intake manifold via a canister purge valve; an air intake throttle coupled between the engine intake manifold and atmosphere; a fuel tank pressure transducer; a key fob; a remote engine start receiver; a controller configured with instructions in non-transitory memory, that when executed cause the controller to: responsive to a signal from the remote engine start receiver of a request for a remote engine start event via a key fob remote signal: commence starting the engine; close the canister vent valve to seal the fuel system and evaporative emissions control system from atmosphere; open the canister purge valve and close the air intake throttle to apply engine intake manifold vacuum created by opening and closing of intake and exhaust valves during engine operation to the fuel system and evaporative emissions system; and responsive to an indication that pressure in the fuel system and evaporative emissions system has reached a predetermined negative pressure threshold: seal the fuel system and evaporative emissions system from engine intake manifold vacuum; monitor pressure in the fuel system and evaporative emissions system for a predetermined duration; and indicate the presence of undesired evaporative emissions responsive to pressure in the fuel system and evaporative emissions system increasing at a rate greater than a predetermined pressure rate increase threshold. In a first example, the system further comprises a fuel temperature sensor; one or more seat load sensors; door sensors; one or more onboard vehicle cameras; and wherein the controller is further configured with instructions stored in non-transitory memory, that when executed cause the controller to: indicate whether the vehicle is occupied via the one or more seat load sensors and/or onboard vehicle camera(s); indicate an open or closed state of vehicle doors and/or vehicle trunk via the door sensors and/or onboard vehicle camera(s); indicate a fuel temperature; and wherein sealing the fuel system and evaporative emissions system from atmosphere and applying engine intake manifold vacuum to the fuel system and evaporative emissions system is conducted responsive to an indication that the vehicle is not occupied, that vehicle doors and vehicle trunk are closed, and that a fuel temperature is below a threshold fuel temperature, where the threshold fuel temperature comprises fuel temperature where fuel does not readily vaporize. A second example of the system optionally includes the first example and further includes wherein the controller is further configured with instructions stored in non-transitory memory, that when executed cause the controller to: at any point subsequent to the indication that the vehicle is not occupied, that vehicle doors and vehicle trunk are closed, and that fuel temperature is below a threshold fuel temperature, if it is further indicated that the vehicle has become occupied, that door(s) and/or trunk of the vehicle are opened, or that fuel temperature has risen above the threshold fuel temperature; seal or maintain sealed the fuel system and evaporative emissions system from engine intake manifold vacuum by commanding closed or maintaining closed the canister purge valve; maintain engine operation; and unseal or maintain unsealed the fuel system and evaporative emissions system from atmosphere by commanding open or maintaining open the canister vent valve.

Another example of a method comprises storing fuel vapors in an evaporative emission control system, including a fuel vapor storage canister, which is coupled to a fuel system which in turn supplies fuel to a combustion engine that propels the vehicle; and responsive to initiating starting of the engine from a location external to the vehicle and an indication that the vehicle is not occupied applying negative pressure on an evaporative emissions space of the fuel system and the evaporative emissions control system of the vehicle to conduct a test for undesired evaporative emissions from the evaporative emissions space. In a first example of the method, the method further comprises selectively coupling the evaporative emissions space to atmosphere via a canister vent valve positioned between the fuel vapor storage canister and atmosphere; and wherein prior to applying negative pressure on the evaporative emissions space the fuel system and evaporative emissions system are sealed from atmosphere by commanding closed or maintaining closed the canister vent valve. A second example of the method optionally includes the first example and further comprises selectively coupling an intake manifold of the engine to the fuel system and evaporative emissions system via a canister purge valve; selectively coupling engine intake to atmosphere via an air intake throttle; wherein operating the engine with the air intake throttle less than fully open creates a negative pressure with respect to atmospheric pressure in the intake manifold of the engine; and wherein applying negative pressure on the evaporative emissions space of the fuel system and evaporative emissions control system further comprises commanding open the canister purge valve to couple vacuum in the intake manifold to the fuel system and evaporative emissions system. A third example of the method optionally includes any one or more or each of the first and second examples and further includes wherein applying negative pressure on the evaporative emissions space to conduct a test for undesired evaporative emissions includes reducing pressure in the fuel system and evaporative emissions system to a predetermined negative pressure and further comprises: sealing the fuel system and evaporative emissions system from vacuum in the intake manifold responsive to an indication that the predetermined negative pressure is reached; monitoring pressure in the fuel system and evaporative emissions system subsequent to sealing the fuel system and evaporative emissions system from vacuum in the intake manifold; indicating undesired evaporative emissions responsive to a subsequent pressure increase rate in the fuel system and evaporative emissions system greater than a threshold pressure increase rate; wherein the pressure increase rate greater than the threshold pressure increase rate indicates undesired evaporative emissions escaping through a source of at least a defined area; and wherein the predetermined negative pressure threshold comprises a negative pressure with respect to atmospheric pressure, the predetermined negative pressure threshold based on a difference from atmospheric pressure sufficient to monitor the subsequent pressure increase rate. A fourth example of the method optionally includes any one or more or each of the first through third examples and further includes wherein indicating whether the vehicle is occupied is based on one or more of seat load cells, and onboard cameras; and wherein applying negative pressure on the evaporative emissions space to conduct a test for undesired evaporative emissions is further responsive to: an indication that doors and the trunk of the vehicle are closed, and that temperature of the fuel is below a fuel temperature threshold where fuel does not readily vaporize; and further comprising aborting the test for undesired evaporative emissions in response to any indication that the vehicle has become occupied, that the door(s) and/or trunk of the vehicle are opened, or that the fuel temperature has risen above the threshold. A fifth example of the method optionally includes any one or more or each of the first through fourth examples and further includes wherein the engine is started from a location external to the vehicle via one of a key fob configured to transmit a remote signal to a remote engine start receiver in the vehicle, or a smartphone based system where a user's cellular telephone sends data to a server and the server communicates with the vehicle to start the engine.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method, comprising:

responsive to a command from a location external to a vehicle to start a combustion engine in the vehicle, sealing a fuel system and an evaporative emissions system from atmosphere;

reducing pressure in the fuel system which supplies fuel to the combustion engine and the evaporative emissions system coupled to the fuel system to a predetermined pressure; and indicating undesired evaporative emissions responsive to a subsequent pressure increase rate in the fuel system and the evaporative emissions system greater than a threshold pressure rate;

the method further comprising:

indicating whether the vehicle is occupied based on one or more of seat load cells and onboard cameras;

indicating whether doors and a trunk of the vehicle are open or closed via one or more of door sensors and the onboard cameras; and indicating a fuel temperature via a fuel tank temperature sensor;

wherein reducing pressure in the fuel system and the evaporative emissions system is further responsive to an indication that the vehicle is not occupied and one or more of the following: that doors and the trunk of the vehicle are closed, and that the fuel temperature is below a fuel temperature threshold;

wherein the pressure in the fuel system is indicated via a fuel tank pressure transducer; and wherein the fuel temperature threshold comprises a fuel temperature where fuel does not readily vaporize.

2. The method of claim 1, wherein the combustion engine is started from the location external to the vehicle via one of a key fob configured to transmit a remote signal to a remote engine start receiver in the vehicle, or a smartphone based system where a user's cellular telephone sends data to a server and the server communicates with the vehicle to start the combustion engine.

3. The method of claim 1, further comprising:

selectively coupling the fuel system and the evaporative emissions system to atmosphere via a canister vent valve;

wherein sealing the fuel system and the evaporative emissions system from atmosphere comprises closing the canister vent valve.

4. The method of claim 1, wherein starting the combustion engine creates an intake manifold vacuum; and wherein reducing pressure in the fuel system and the evaporative emissions system comprises applying the intake manifold vacuum to the fuel system and the evaporative emissions system.

5. The method of claim 4, further comprising:

responsive to reaching a predetermined negative pressure threshold, sealing the fuel system and the evaporative emissions system from the intake manifold vacuum.

6. The method of claim 5, further comprising:

selectively coupling the intake manifold vacuum to the fuel system and the evaporative emissions system via a canister purge valve; and selectively coupling an engine intake to atmosphere via an air intake throttle;

wherein reducing pressure in the fuel system and the evaporative emissions system comprises applying the intake manifold vacuum to the fuel system and the evaporative emissions system by opening the canister purge valve and closing the air intake throttle; and wherein sealing the fuel system and the evaporative emissions system from the intake manifold vacuum includes closing the canister purge valve.

7. The method of claim 5, wherein indicating undesired evaporative emissions responsive to the subsequent pressure increase rate in the fuel system and the evaporative emissions system greater than the threshold pressure rate includes monitoring pressure in the fuel system and the evaporative emissions system subsequent to sealing the fuel system and the evaporative emissions system from the intake manifold vacuum; and wherein the subsequent pressure increase rate greater than the threshold pressure rate indicates undesired evaporative emissions escaping through a source of at least a defined area.

8. The method of claim 7, wherein the predetermined negative pressure threshold comprises a negative pressure with respect to atmospheric pressure, the predetermined negative pressure threshold based on a difference from atmospheric pressure sufficient to monitor the subsequent pressure increase rate.

9. The method of claim 5, further comprising:

prior to indicating a presence or absence of the undesired evaporative emissions, and responsive to an indication that the vehicle has become occupied, that one or more doors and/or the trunk of the vehicle are opened, or that the fuel temperature has risen above the fuel temperature threshold, stopping applying the intake manifold vacuum to the fuel system and the evaporative emissions system; and unsealing the fuel system and the evaporative emissions system from atmosphere.

10. A system for a vehicle, comprising:

an engine comprising one or more cylinders, each cylinder comprising an intake valve and an exhaust valve;

a fuel tank configured within a fuel system;

a fuel vapor canister, configured within an evaporative emissions control system, coupled to the fuel tank, coupled to atmosphere via a canister vent valve, and coupled to an engine intake manifold via a canister purge valve;

an air intake throttle coupled between the engine intake manifold and atmosphere;

a fuel tank pressure transducer;

a key fob;

a remote engine start receiver;

a controller configured with instructions in non-transitory memory that, when executed, cause the controller to:

responsive to a signal from the remote engine start receiver of a request for a remote engine start event via a key fob remote signal, commence starting the engine;

close the canister vent valve to seal the fuel system and the evaporative emissions control system from atmosphere; and open the canister purge valve and close the air intake throttle to apply an engine intake manifold vacuum created by opening and closing of the intake and exhaust valves during engine operation to the fuel system and the evaporative emissions control system; and responsive to an indication that pressure in the fuel system and the evaporative emissions control system has reached a predetermined negative pressure threshold, seal the fuel system and the evaporative emissions control system from the engine intake manifold vacuum;

monitor the pressure in the fuel system and the evaporative emissions control system for a predetermined duration; and indicate a presence of undesired evaporative emissions responsive to the pressure in the fuel system and the evaporative emissions control system increasing at a rate greater than a predetermined pressure rate increase threshold;

a fuel temperature sensor;

one or more seat load sensors;

door sensors; and one or more onboard vehicle camera(s);

wherein the controller is further configured with instructions stored in non-transitory memory that, when executed, cause the controller to:

indicate whether the vehicle is occupied via the one or more seat load sensors and/or the one or more onboard vehicle camera(s);

indicate an open or closed state of vehicle doors and/or a vehicle trunk via the door sensors and/or the one or more onboard vehicle camera(s); and indicate a fuel temperature;

wherein sealing the fuel system and the evaporative emissions control system from atmosphere and applying the engine intake manifold vacuum to the fuel system and the evaporative emissions control system is conducted responsive to an indication that the vehicle is not occupied, that the vehicle doors and the vehicle trunk are closed, and that the fuel temperature is below a threshold fuel temperature, where the threshold fuel temperature comprises a fuel temperature where fuel does not readily vaporize.

11. The system of claim 10, wherein the controller is further configured with instructions stored in non-transitory memory that, when executed, cause the controller to:

at any point subsequent to the indication that the vehicle is not occupied, that the vehicle doors and the vehicle trunk are closed, and that the fuel temperature is below the threshold fuel temperature, if it is further indicated that the vehicle has become occupied, that the vehicle door(s) and/or the vehicle trunk are opened, or that the fuel temperature has risen above the threshold fuel temperature, seal or maintain sealed the fuel system and the evaporative emissions control system from the engine intake manifold vacuum by commanding closed or maintaining closed the canister purge valve;

maintain engine operation; and unseal or maintain unsealed the fuel system and the evaporative emissions control system from atmosphere by commanding open or maintaining open the canister vent valve.

12. A method for a vehicle comprising:

storing fuel vapors in an evaporative emissions control system, including a fuel vapor storage canister, which is coupled to a fuel system which in turn supplies fuel to a combustion engine that propels the vehicle;

determining a first entry condition and a second entry condition are met at overlapping times, where the first entry condition is a condition where starting of the combustion engine is initiated and the second entry condition is a condition where an indication that the vehicle is not occupied is generated; and operating with the first and second entry conditions occurring in the vehicle at overlapping times, and, responsive to determining that the first and second entry conditions are met, applying a negative pressure on an evaporative emissions space of the fuel system and the evaporative emissions control system of the vehicle to conduct a test for undesired evaporative emissions from the evaporative emissions space.

13. The method of claim 12, further comprising:

selectively coupling the evaporative emissions space to atmosphere via a canister vent valve positioned between the fuel vapor storage canister and atmosphere;

wherein, prior to applying the negative pressure on the evaporative emissions space, the fuel system and the evaporative emissions control system are sealed from atmosphere by commanding closed or maintaining closed the canister vent valve.

14. The method of claim 12, further comprising:

selectively coupling an intake manifold of the combustion engine to the fuel system and the evaporative emissions control system via a canister purge valve; and selectively coupling an engine intake to atmosphere via an air intake throttle;

wherein operating the combustion engine with the air intake throttle less than fully open creates the negative pressure with respect to an atmospheric pressure in the intake manifold of the combustion engine; and wherein applying the negative pressure on the evaporative emissions space of the fuel system and the evaporative emissions control system further comprises commanding open the canister purge valve to couple a vacuum in the intake manifold of the combustion engine to the fuel system and the evaporative emissions control system.

15. The method of claim 14, wherein applying the negative pressure on the evaporative emissions space to conduct the test for undesired evaporative emissions includes reducing pressure in the fuel system and the evaporative emissions control system to a predetermined negative pressure and further comprises:

sealing the fuel system and the evaporative emissions control system from the vacuum in the intake manifold responsive to an indication that the predetermined negative pressure is reached;

monitoring the pressure in the fuel system and the evaporative emissions control system subsequent to sealing the fuel system and the evaporative emissions control system from the vacuum in the intake manifold of the combustion engine; and indicating undesired evaporative emissions responsive to a subsequent pressure increase rate in the fuel system and the evaporative emissions control system greater than a threshold pressure increase rate;

wherein the subsequent pressure increase rate greater than the threshold pressure increase rate indicates undesired evaporative emissions escaping through a source of at least a defined area;

wherein the predetermined negative pressure comprises the negative pressure with respect to the atmospheric pressure, and wherein the predetermined negative pressure is determined based on a difference from the atmospheric pressure sufficient to monitor the subsequent pressure increase rate; and wherein the pressure in the fuel system is indicated via a fuel tank pressure transducer.

16. The method of claim 12, wherein indicating whether the vehicle is occupied is based on one or more of a plurality of seat load cells and a plurality of onboard cameras; and wherein applying the negative pressure on the evaporative emissions space to conduct the test for undesired evaporative emissions is further responsive to: an indication that one or more doors and a trunk of the vehicle are closed, and that a temperature of a fuel in the fuel system is below a fuel temperature threshold where the fuel does not readily vaporize; and the method further comprising aborting the test for undesired evaporative emissions in response to an indication that the vehicle has become occupied, that the one or more doors and/or the trunk of the vehicle are opened, or that the fuel temperature has risen above the fuel temperature threshold.

17. The method of claim 12, wherein the combustion engine is started from a location external to the vehicle via one of a key fob configured to transmit a remote signal to a remote engine start receiver in the vehicle, or a smartphone based system where a user's cellular telephone sends data to a server and the server communicates with the vehicle to start the combustion engine.

* * * * *